United States Patent [19]

Kanekubo

[11] Patent Number: 4,518,496

[45] Date of Patent: May 21, 1985

[54] LIQUID BRANCH FLOW GUIDE CONDUIT ASSEMBLY FOR USE IN A MAGNETIC APPARATUS FOR SEPARATING FOREIGN MATTERS FROM WASTE LIQUIDS CONTAINING THE FOREIGN MATTERS

[76] Inventor: Minoru Kanekubo, 1012-3 Sugito, Sugito-Machi, Kitakatsushika-Gun, Saitama-Ken, Japan

[21] Appl. No.: 455,896

[22] Filed: Jan. 5, 1983

[51] Int. Cl.[3] ..... B03C 1/16

[52] U.S. Cl. ..... 210/222; 137/592; 210/526

[58] Field of Search ..... 210/413, 460, 222, 223, 210/526, 533, 537, 540, 400, 401, 416.2, 459, 416.3; 209/225, 228; 137/590, 592

[56] References Cited

U.S. PATENT DOCUMENTS

| | | | |
|---|---|---|---|
| 1,694,668 | 12/1928 | Peters | 210/172 |
| 1,977,464 | 10/1934 | White | 210/460 |
| 2,192,438 | 3/1940 | Gulick | 210/460 |
| 2,783,890 | 3/1957 | Harlan | 210/222 |
| 3,189,126 | 6/1965 | May | 137/590 |
| 3,600,771 | 8/1971 | Dyrander | 210/460 |
| 3,613,894 | 10/1971 | Clegg, Jr. | 210/459 |
| 3,712,472 | 1/1973 | Elliot | 210/222 |
| 3,748,835 | 7/1973 | Panzica | 210/413 |

*Primary Examiner*—Richard V. Fisher
*Assistant Examiner*—W. Gary Jones
*Attorney, Agent, or Firm*—Wenderoth, Lind & Ponack

[57] ABSTRACT

A liquid branch flow guide conduit assembly for use in a magnetic apparatus for separating foreign matters from waste liquids containing such foreign matters. The liquid branch flow guide conduit assembly has a flat base having a center raised portion providing a recess in the undersurface of the base, a pipe support member provided on the base surrounding the raised portion in spaced relationship to the raised portion and having a center opening, an upright drain pipe extending uprightly from the raised portion through the opening in the support member and opening at the bottom into the center opening in the raised portion, an elbow connected at one end to the upper end of the upright drain pipe and a horizontal drain pipe connected at one end to the elbow and opening at the other end into the exterior of the magnetic separating apparatus.

1 Claim, 4 Drawing Figures

LIQUID BRANCH FLOW GUIDE CONDUIT ASSEMBLY FOR USE IN A MAGNETIC APPARATUS FOR SEPARATING FOREIGN MATTERS FROM WASTE LIQUIDS CONTAINING THE FOREIGN MATTERS

BACKGROUND OF THE INVENTION

This invention relates to a magnetic apparatus for separating foreign matter from waste liquids containing the foreign matter and more particularly, to a liquid branch flow guide conduit assembly for use in the magnetic separating apparatus.

There have been proposed and practically employed a variety of liquid branch flow guide conduit assemblies for use in magnetic apparatus for separating foreign matter from waste liquids containing the foreign matter. However, each of the prior art liquid branch flow guide conduit assemblies has its own inherent disadvantages. In order to eliminate the disadvantages inherent in the prior art guide conduit assemblies, I made an experimental liquid branch flow guide conduit assembly of the type which comprises a flat base having an opening in the center thereof, an upright liquid drain pipe extending uprightly from the center of the base and opening at the bottom into the center opening in the base, an elbow connected to the upper end of the upright drain pipe and a horizontal drain pipe connected at one end to the elbow and opening at the other end into the exterior of the magnetic apparatus. However, the experimental liquid branch flow guide conduit assembly had the grave disadvantage that because metallic and nonmetallic foreign matter contained in waste liquids to be treated tended to easily deposit on the base in and adjacent to the center opening where the upright drain pipe opens, the liquid passage provided by the center opening in the base and the hollow interior of the drain pipe tended to be easily clogged with the foreign matter and the foreign matters corroded the drain pipe as time passed.

SUMMARY OF THE INVENTION

Therefore, the present invention has as its object to provide a novel and improved liquid branch flow guide conduit assembly which can effectively eliminate the disadvantage inherent in the above-mentioned prior art and experimental liquid branch flow guide conduit assemblies.

The purpose of the present invention is to provide a liquid branch flow guide conduit assembly which improves the foreign matter separation function of a magnetic apparatus for separating metallic and nonmetallic foreign matter from waste liquids such as coolants containing such foreign matter which come from the operation and/or cleaning of metal working machines and are introduced into the treating chambers of the apparatus.

The above and other objects and attendant advantages of the present invention will be more readily apparent to those skilled in the art from a reading of the following detailed description in conjunction with the accompanying drawings which show one embodiment of the invention for illustration purpose only, but not for limiting the scope of the same in any way.

PREFERRED EMBODIMENT OF THE INVENTION

Figure 1:
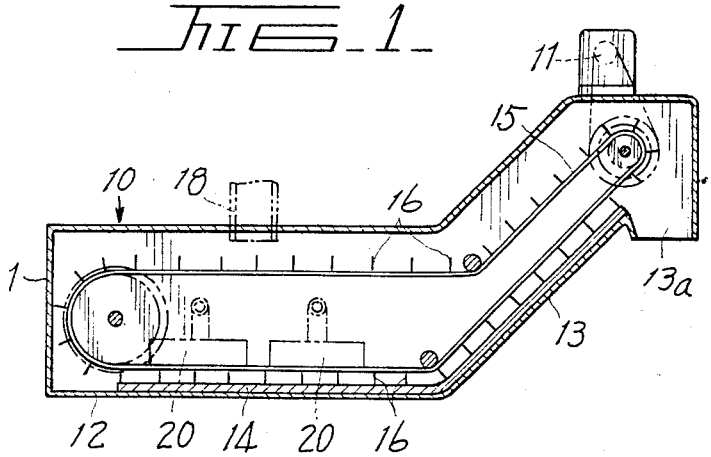
FIG. 1 is a longitudinal sectional view of a typical treating chamber associated with a magnetic apparatus for separating foreign matter from a waste liquid flow in which a plurality of liquid branch flow guide conduit assemblies of the invention are incorporated.
Figure 2:
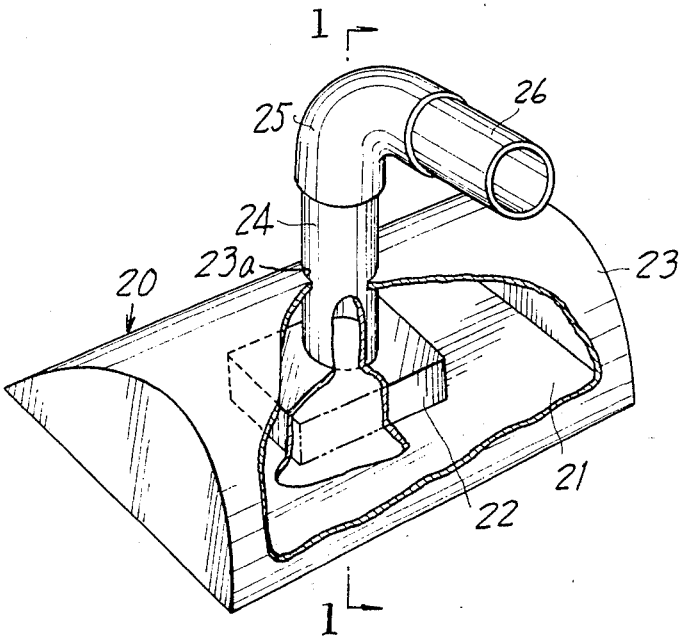
FIG. 2 is a perspective view on an enlarged scale of one of the liquid branch flow guide conduit assemblies as shown in FIG. 1 with a portion of the guide conduit assembly broken away.
Figure 3:
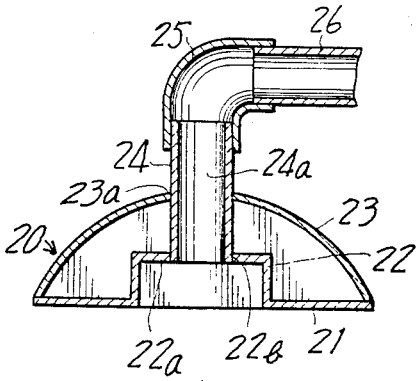
FIG. 3 is a vertical sectional view taken along substantially the line I—I of FIG. 2 and as seen in the direction of the arrows therein.
Figure 4:
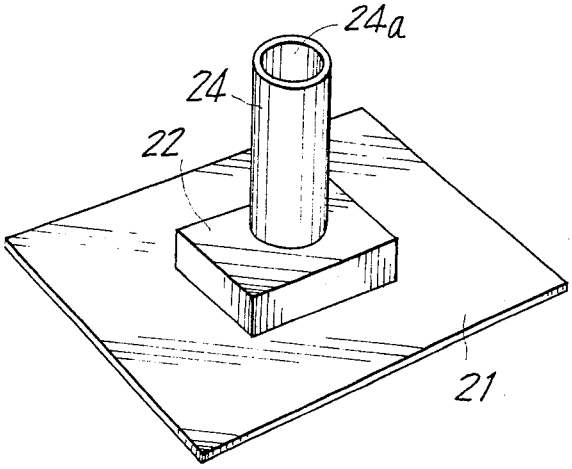
FIG. 4 is a perspective view of a portion of the liquid branch flow guide conduit assembly as shown in FIGS. 2 and 3.

The present invention will be now described referring to the accompanying drawings, and more particularly FIG. 1 thereof, in which a treating chamber associated with a typical magnetic apparatus for separating foreign matter from a waste liquid flow containing the foreign matter has a plurality of liquid branch flow guide conduit assemblies of the invention (only two assemblies are shown) incorporated therein. The magnetic apparatus 10 generally comprises an elongated treating chamber 1 which integrally includes a left-hand horizontal portion 12 and a right-hand upwardly inclined portion 13. The bottom of the upwardly inclined portion 13 is provided at the right-hand or upper end of the portion 13 with a separated foreign matter discharge port 13*a*. A magnet plate 14 is disposed on the inner surface of the bottom wall of the treating chamber 1 and extends from a point adjacent to and short of the left-hand end wall towards the right-hand end wall and terminates at the separated foreign matter discharge port 13*a* in the upwardly inclined portion 13. An endless chain conveyer 15 is trained about drive and driven chain sprockets which are rotatably mounted by suitable conventional means (not shown) in the treating chamber adjacent to and short of the opposite end walls thereof by suitable conventional means. The chain conveyer 15 passes along the path defined by the chain sprockets disposed adjacent to the opposite ends of the chamber and guide rollers disposed at the junction between the horizontal and upwardly inclined portions 12, 13 of the treating chamber 1 and mounted by suitable conventional means (not shown). The chain conveyer 15 has a plurality of equally spaced upright flight bars 16 on the outer side of the conveyer. As the chain conveyer 15 passes along the path, the flight bars 16 on the lower run of the chain conveyer 15 frictionally slide on the magnet plate 14. In FIG. 1, reference numeral 11 denotes a drive means for the chain conveyer 15 and the drive means is drivingly connected to the drive chain sprocket positioned adjacent to the right-hand end of the treating chamber 1 through an endless drive belt which is trained about a pulley coaxial with the drive chain sprocket and a pulley on the drive means 11. The treating chamber 1 also includes a waste liquid supply pipe 18 which opens at the lower end into the treating chamber 1 and connects at the upper end to a waste liquid discharge system of a metal working machine from which a waste liquid such as used coolant to be treated is supplied to the magnetic apparatus.

In operation, a liquid to be treated such as used coolant which contains metallic foreign matter such as chips and/or iron fragments, for example, is introduced via the liquid supply pipe 18 into the interior of the treating chamber 1 and the foreign matter is caused to be deposited on the magnet plate 14 which attracts the foreign matter thereto and holds the foreign matter thereon. The foreign matter attracted to and held on the magnet plate 14 is then scraped off the magnet plate 14 and carried towards the discharge port 13*a* by the flight bars 16 on the lower run of the chain conveyer 15 as the chain conveyer continues to move in the counter-clockwise direction. Each time each of the successive flight bars 16 on the lower run of the chain conveyer 15 passes over the discharge port 13*a*, the portion of the foreign matter being carried by the flight bar is thrown into the discharge port 13*a* from where the portion of the foreign matter is discharged out of the treating chamber 1. After the removal treatment of the foreign matter, the treated or foreign matter-free liquid is divided into branch flows and guided by the liquid branch flow guide conduit assemblies of the present invention. Although two liquid branch flow guide conduit assemblies are shown in FIG. 1, it will be appreciated that the number of the guide conduit assemblies may be varied as necessary or desired within the scope of the present invention.

Since the liquid branch flow guide conduit assemblies are identical with each other, only one of the guide assemblies will be described in detail hereinafter with the understanding that the description can be equally applied to the other guide conduit assemblies.

The liquid branch flow guide conduit assembly is generally indicated by 20 and generally comprises a substantially flat imperforate base 21 which is raised in the center thereof as shown by 22 to provide a recess 22*a* in the center of the undersurface of the base, the raised portion 22 being provided in the center of the top thereof with a circular opening 22*b*, a hollow pipe support member 23 having a domed cross-section as seen in end elevation and extending upwardly from the base 21 surrounding the center raised portion 22 in spaced relationship thereto, the support member having formed in the center of the top thereof a circular opening 23*a*, an upright drain pipe 24 extending uprightly from the top of the center raised portion 22 through the center opening 23*a* in the support member 23 and opening at the bottom into the opening 22*b* in the raised portion 22 to provide a liquid passage 24*a* which extends from the raised portion center opening 22*b* through the interior of the drain pipe 24, an elbow 25 connected at one end to the top of the upright drain pipe 24 and at the other end to a horizontal drain pipe 26 which opens at the other or outer end to the exterior of the treating chamber 1. The liquid branch flow guide conduit assembly 20 is suitably mounted within the treating chamber 1 with the base 21 parallel to the magnet plate 14 and between the upper and lower runs of the conveyor and slightly spaced from the upper surface of the lower run of the chain conveyer 15 so that the conduit assembly will not interfere with the movement of the chain conveyer lower run. The flat base 21 and the magnet plate 14 define a flow passage between them having an inlet opening around the periphery of the flat base 21 between the flat base 21 and the magnet plate 14 and an outlet constituted by the drain pipe 26.

In the operation of the magnetic apparatus for separating foreign matter from a waste liquid flow such as waste coolant containing foreign matter, as the waste liquid is continuously fed into the treating chamber 1 through the waste liquid supply pipe 18, the volume of the waste liquid within the treating chamber gradually increases so as to submerge the magnet plate 14, the lower run of the chain conveyer 15 and the liquid branch flow guide conduit assemblies 20 in succession.

When the waste liquid being introduced into the treating chamber 1 passes through the space defined between the upper surface of the magnet plate 14 and the undersurface of the base 21 of each of the liquid branch flow guide conduit assemblies 20, the metal foreign matter contained in the waste liquid is attracted to and held on the magnet plate 14 whereas the waste liquid from which the foreign matter has been removed enters the recess 22*a* in the base 21 as a branch flow and then flows upwardly through the liquid passage 24*a* in the upright pipe 24. The waste liquid branch flow then passes through the elbow 25 into the horizontal drain pipe 26 from where the liquid branch flow discharges out of the treating chamber 1.

As described hereinabove, since the waste liquid supplied into the treating chamber 1 positively passes through the space defined between the upper surface of the magnet plate 14 and the undersurface of the base 21 of each of the liquid branch flow guide conduit assemblies 20 before the liquid discharges out of the treating chamber 1, while the waste liquid is passing through the space, the metal foreign matter contained in the waste liquid is attracted to and deposited on the magnet plate 14 as described hereinabove. However, the waste liquid may also contain non-metallic foreign matter in addition to metallic foreign matter and such nonmetallic foreign matter precipitates through the body of the waste liquid by gravity and is deposited on the magnet plate 14 together with the attracted foreign matter. Both the metallic and nonmetallic foreign matter are scraped off the magnet plate 14 and carried by the flight bars 16 on the lower run of the moving chain conveyer 15 to the discharge port 13*a* in the bottom of the treating chamber 1 from where the foreign matters are discharged out of the treating chamber 1 whereas the body of the foreign matter-free waste liquid enters the recesses in the bottoms of the liquid branch flow guide conduit assemblies as a plurality of branch flows which then pass through the upright pipes 24, elbows 25 and horizontal drain pipes 26 from where the liquid branch flows discharge out of the treating chamber 1 as described hereinabove. In order to effectively carry out the foreign material separation operation, it is preferable that the area of the undersurface of the base be as large as possible and the area and length of the magnet plate also be as large and long as possible to thereby provide a sufficiently large foreign matter separation zone.

I wish it to be understood that my invention is not to be limited to the specific embodiment and the arrangement shown and described, except only insofar as the claims may be so limited, as it will be understood by those skilled in the art that changes may be made without departing from the principle of the invention.

I claim:

1. A magnetic apparatus for separating magnetic foreign matter from waste liquids containing the foreign matter, comprising:

means defining an elongated treating chamber;

an endless chain conveyor mounted in said treating chamber and extending in a closed loop therein with upper and lower runs and having a plurality of spaced flight bars extending outwardly from the conveyor;

a magnet plate along the inner surface of the bottom of said treating chamber, the lower run of said conveyor extending along said magnet plate with said flight bars frictionally engaging said magnet plate; and at least one liquid branch flow guide assembly having an imperforate flat base positioned between said runs and spaced slightly above said lower run of said conveyor and having a raised center portion defining an unobstructed recess opening out of the undersurface of the center of said base and having a first center opening in said center portion opposite the position where the recess opens out of the base, a pipe support member on said base surrounding said center raised portion and extending up and over and in spaced relationship to said raised center portion and having a second center opening, a drain pipe having an upright portion extending from said first center opening through said second center opening and opening at the lower end into said first center opening into said raised portion, said pipe having an elbow portion connected to the upper end of said upright portion and a horizontal drain portion connected to said elbow portion and extending out of said treating chamber, a flow passage being defined between said flat base and said magnet plate having an inlet opening around the periphery of said flat base between said flat base and said magnet plate and an outlet to said flow passage constituted by said drain pipe, for, when liquid flows out of said drain pipe, the liquid in said treating chamber is caused to flow between said flat plate and said magnet plate to conduct the liquid over the magnet plate for allowing the magnetic attraction of the magnet plate to be exerted on the magnetic foreign matter in the liquid before the liquid reaches said recess.

* * * * *